United States Patent [19]

Fukui

[11] Patent Number: 5,001,759

[45] Date of Patent: Mar. 19, 1991

[54] METHOD AND APPARATUS FOR SPEECH CODING

[75] Inventor: Akira Fukui, Tokyo, Japan

[73] Assignee: NEC Corporation, Japan

[21] Appl. No.: 414,643

[22] Filed: Sep. 27, 1989

Related U.S. Application Data

[63] Continuation of Ser. No. 96,553, Sep. 14, 1987, abandoned.

[30] Foreign Application Priority Data

Sep. 18, 1986 [JP] Japan ..... 61-221308

[51] Int. Cl.[5] ..... G10L 5/00

[52] U.S. Cl. ..... 381/38; 381/49

[58] Field of Search ..... 381/34–49

[56] References Cited

U.S. PATENT DOCUMENTS 4,720,865 1/1988 Taguchi ..... 381/49

4,776,015 10/1988 Takeda et al. ..... 381/49

OTHER PUBLICATIONS

"A New Model of LPC Excitation for Producing Natural-Sounding Speech at Low Bit Rates" ICASSP, pp. 614–617, 1982, Atal, et al.

"Multi-Pulse Excited Speech Coder Based on Maximum Crosscorrelation Speech Algorithm" IEEE Global Telecommunications Conf., 23.3, 12/87, Ozawa, et al.

"A Study on Pulse Search Algorithms for Multipulse Excited Speech Coder Realizations" IEEE Journal on Selected Areas in Communications, vol. SAC-4, No. 1, Jan. 1986.

*Primary Examiner*—Emanuel S. Kemeny

*Attorney, Agent, or Firm*—Laff, Whitesel, Conte & Saret

[57] ABSTRACT

A multi-pulse speech coding method and apparatus capable of encoding speech at a bit rate of 16 kbps or less. The method determines the location and amplitude of a pulse by searching through all of the samples of a criterion function, modifying all of the samples of the criterion function, and them repeating the pulse search. After the predetermined number of pulses have been determined, the method modifies the amplitude of the determined pulse, modifies the criterion function at the location where the pulses are set, and repeats such pulse amplitude modification. The method is, therefore, capable of modifying a pulse amplitude by using only a minimum amount of computation. As compared to the amount of computerization required by a method of the kind which modifies pulse amplitude in a pulse search loop.

1 Claim, 3 Drawing Sheets

Fig.3a

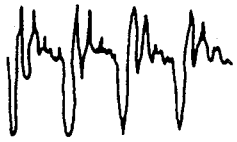

INPUT SIGNAL X(n) OR WEIGHTED SIGNAL Xw (n)

Fig.3b

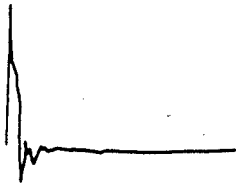

IMPULSE RESPONSE OF LINEAR PREDICTIVE FILTER h(n) OR WEIGHTED IMPULSE RESPONSE hw(n)

Fig.3c

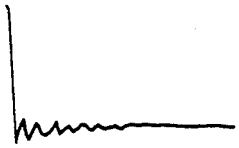

AUTO CORRELATION OF IMPULSE RESPONSE Rhh(n)

Fig.3d

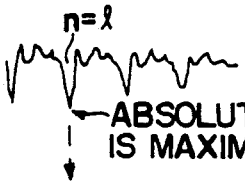

FIRST CRITERION
CROSS CORRELATION OF INPUT SIGNAL AND IMPULSE RESPONSE OF LINEAR PREDICTIVE FILTER Rhx(n)

Fig.3e

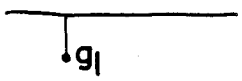

FIRST PULSE $g_1$ =R(ℓ)(Rhhro)

Fig.3f

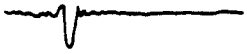

AUTO CORRELATION NORMALIZED TO AN AMPLITUDE OF THE FIRST PULSE $g_1$ AT A LOCATION WHERE THE FIRST PULSE IS SET

Fig.3g

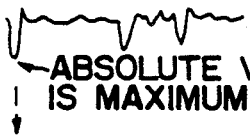

CRITERION (d)−(f)

Fig.3h

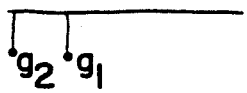

FIRST PULSE AND SECOND PULSE

Fig.3i

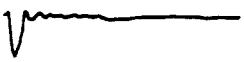

AUTO CORRELATION NORMALIZED TO AN AMPLITUDE OF THE SECOND PULSE $g_2$ AT A LOCATION WHERE THE SECOND PULSE IS SET

Fig.3j

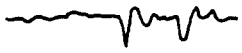

CRITERION (g)-(i)

METHOD AND APPARATUS FOR SPEECH CODING

This application is a continuation, of application Ser. No. 07/096,553, filed 9/14/87, now abandoned.

BACKGROUND OF THE INVENTION

The present invention relates to a method and an apparatus for low bit rate speech signal coding.

Searching an excitation sequence of a speech signal at short time intervals is a method known in the art which is capable of coding a speech signal at a transmission rate of 10 kilobits per second (kbps) or less, provided that an error in the signal reproduced by using the sequence relative to an input signal is minimal. For example, an A-b-S (Analysis-by-Synthesis) method (prior art 1) proposed by B. S. Atal at Bell Telephone Laboratories of the United States is worth notice in that the excitation sequence is represented by a plurality of pulses so as to provide the amplitudes and the phases on the coder side at short time intervals. For details of such a method, a reference may be made to "A NEW MODEL OF LPC EXCITATION FOR PRODUCING NATURAL-SOUNDING SPEECH AT LOW BIT RATES," ICASSP, pp. 614–617, 1982 (reference 1). However, a problem with the prior art 1 is that the A-b-S method used to determine the pulse sequence needs a prohibitive amount of calculation. Another prior art approach (prior art 2) for determining a pulse sequence and which is elaborated to decrease the calculation amount is described by T. Araseki, K. Osawa, S. Ono and K. Ochiai in "MULTI-PULSE EXCITED SPEECH CODER BASED ON MAXIMUM CROSS-CORRELATION SPEECH ALGORITHM," IEEE Global Telecommunications Conference, 23.3, Dec. 1987 (reference 2). Various pulse search algorithms (prior art 3) of the type using correlation functions have been proposed by K. Ozawa, S. Ono and T. Araseki in "A Study on Pulse Search Algorithms for Multipulse Excited Speech Coder Realization," IEEE Journal on Selected Areas in Communications, Vol. SAC-4, No. 1, Jan. 1986 (Reference 3). In accordance with the prior art 3, sound is reproducible with high quality for transmission rates of 8 to 16 kbps.

The prior art method which uses correlation functions may be outlined as follows. The excitation sequence comprising K pieces of pulse sequence within a frame is expressed as:

$$V(n) = \sum_{k=1}^{K} g_k \, \delta(n - m_k) n = 1, 2, \ldots, N \qquad \text{Eq. (1)}$$

where $\delta(\cdot)$ is $\delta$ of Kronecker, N is the frame length, and $g_k$ is the pulse amplitude at a location $m_k$.

LPC (Linear Predictive Coding) parameters for a synthesis filter are determined from the covariance of speech signal X (n) constructed into a frame. The synthesis filter characteristic H (z) is given, in the Z-transform notation, by:

$$H(z) = 1/\left(1 - \sum_{i=1}^{P} a_i z^{-i}\right) \qquad \text{Eq. (2)}$$

where $a_i$ are filter coefficients for the LPC synthesis filter, and P is the filter order.

Let h (n) be the impulse response of the synthesis filter. Then, the reproduced signal Y (n) obtained by inputting V (n) to the synthesis filter can be written as:

$$\begin{aligned} Y(n) &= V(n) * h(n) \\ &= \sum_{k=1}^{K} g_k \, h(n - m_k) \end{aligned} \qquad \text{Eq. (3)}$$

where * is representative of convolutional integration.

The weighted mean squared error between the input speech signal X (n) and the reproduced signal Y (n) within one frame is given by:

$$E = \sum_{n=1}^{N} ((X(n) - Y(n)) * W(n))^2 \qquad \text{Eq. (4)}$$

where W (n) is the weighting function. The weighting function W (n) is introduced to reduce perceptual distortion in the reproduced speech. According to the audio masking effect, noise tends to be suppressed in a zone where the speech energy is greater. The weighting function is determined based on the audio characteristics. As regards the weighting function, there has been proposed a Z-transform function W (z) which uses a real constant $\gamma$ and a predictive parameter $a_i$ of the synthesis filter under the condition of $0 \leqq \gamma \leqq 1$ (see the reference 1), i.e., $$W(z) = \left(1 - \sum_{i=1}^{P} a_i z^{-i}\right) / \left(1 - \sum_{i=1}^{P} a_i r^i z^{-i}\right) \qquad \text{Eq. (5)}$$

The Eq. (4) may be rewritten as:

$$E = \sum_{n=1}^{N} \left(X_w(n) - \sum_{k=1}^{K} g_k \, h_w(n - m_k)\right)^2 \qquad \text{Eq. (6)}$$

where $X_w$ (n) and $h_w$ (n) stand for weighted signals of X (n) and h (n), respectively.

Assuming that k−1 pulses were determined, k-th pulse location $m_k$ is given by setting derivative of the error power E with respect to the k-th amplitude $g_k$ to zero for $1 \leqq m_k \leqq N$. Hence, there holds an equation:

$$g_k = \frac{\sum_{n=1}^{N} X_w(n) \, h_w(n - m_k) - \sum_{i=1}^{k-1} \left[ g_i \sum_{n=1}^{N} h_w(n - m_i) \, h_w(n - m_k) \right]}{\sum_{n=1}^{N} h_w(n - m_k) \, h_w(n - m_k)} \qquad \text{Eq. (7)}$$

From the above Eqs. (6) and (7), it will be seen that the optimum pulse location is given at the point $m_k$ where the absolute value of $g_k$ is maximum. By properly processing the frame edge, the above equations can be further reduced to:

$$g_k = \frac{Rhx(mk) - \sum_{i=1}^{k-1} g_i \, Rhh(|m_i - m_k|)}{Rhh(o)} \qquad \text{Eq. (8)}$$

$$1 \leqq m_i, m_k \leqq N$$

where

-continued $$Rhx(m_k) = \sum_{n=1}^{N} X_w(n) \cdot h_w(n - m_k) \quad \text{Eq. (9)}$$

$$1 \leqq m_k \leqq N$$

$$Rhh(n) = \sum_{m=1}^{N-n} h_w(m) \cdot h_w(m + n) \quad \text{Eq. (10)}$$

$$0 \leqq n \leqq N - 1$$

Rhx ($m_k$) is the crosscorrelation function between the weighted speech $X_w$ (n) and the weighted impulse response $h_w$ (n). Rhh ($|m_k - m_i|$) is the autocorrelation function of the weighted impulse response $h_w$ (n).

Actual pulse search is performed by using error criterion function R (n). In the first stage (k=1), R (n) is the same as the crosscorrelation Rhx (n). The absolute maximum of R (n) is searched for, and the optimum pulse location is determined. The amplitude is determined from the Eq. (8) by using the obtained location $m_1$. R (m) is modified by subtracting the produced $g_k$Rhh (n) from R (n). Then, after increasing k, the next pulse search is executed based on maximum crosscorrelation search, until the actual number of pulses exceeds a predetermined one. R (n) in the k-th stage R $(n)^{(k)}$ is represented by:

$$\begin{aligned} R(n)^{(k)} &= Rhx(n) - \sum_{i=1}^{k-1} g_i \cdot Rhh(|m_i - n|) \\ &= R(n)^{(k-1)} - g_i \cdot Rhh(|m_{k-1} - n|) \end{aligned} \quad \text{Eq. (11)}$$

As regards the pulse search, there have been proposed four different methods (prior art 3), i.e., a method 2 which, when the k-th pulse has been determined, adjusts its amplitude and the amplitudes of k−1 pulses determined before, a method 2—2 which adjusts the amplitude of the k-th pulse and those of two pulses nearest thereto, a method 2-1 which adjusts the amplitude of the k-th pulse and that of one pulse nearest thereto, and a method 1 which does not perform any amplitude adjustment. The quality of sound reproduction sequentially becomes high in the order of the methods 1, 2—2, 2—2 and 2. However, as regards the calculation amount necessary for pulse search, the methods 2-1, 2—2 and 2 are, respectively, substantially twice, three times and K/2 times greater than the method 1 and, therefore, impractical.

SUMMARY OF THE INVENTION

It is therefore an object of the present invention to provide a coding method and an apparatus therefor which, in multi-pulse coding for coding speech at a bit rate of 16 kbps or less, achieves high sound quality with a minimum of calculation.

It is another object of the present invention to provide a generally improved method and an apparatus for speech coding.

In a speech coding system which applies a linear predictive analysis to an input signal to determine an impulse response of a linear predictive filter and, then, crosscorrelation between the input signal and the impulse response to use the crosscorrelation for a criterion function, sets a first pulse at a location where the criterion function is maximum, produces a new criterion function by subtracting from the autocorrelation of the impulse response which is normalized to a magnitude of the pulse at the location where the pulse is set from the criterion function, determines a predetermined number of pulses in a same manner based on the criterion function, and transmits coefficients of the linear predictive filter and locations and amplitudes of the predetermined number of pulses; in accordance with the present invention, after the predetermined number of pulses have been determined, the amplitude of the pulse set at, among the locations where the pulses are set, the location where the absolute value of the criterion function is maximum is modified, the autocorrelation of the impulse response which is normalized to a modified amount of the pulse at the location where the amplitude of pulse is modified is subtracted from the criterion function to produce a new criterion function, and pulse amplitude modification is repeated a predetermined number of times based on the new criterion function.

The above and other objects, features and advantages of the present invention will become more apparent from the following description taken with the accompanying drawings.

BRIEF DESCRIPTION OF THE DRAWINGS

FIG. 3 is a self-explanatory line chart showing the relationship between wave forms mentioned in the specification and claims.

DESCRIPTION OF THE PREFERRED EMBODIMENT

Figure 1:
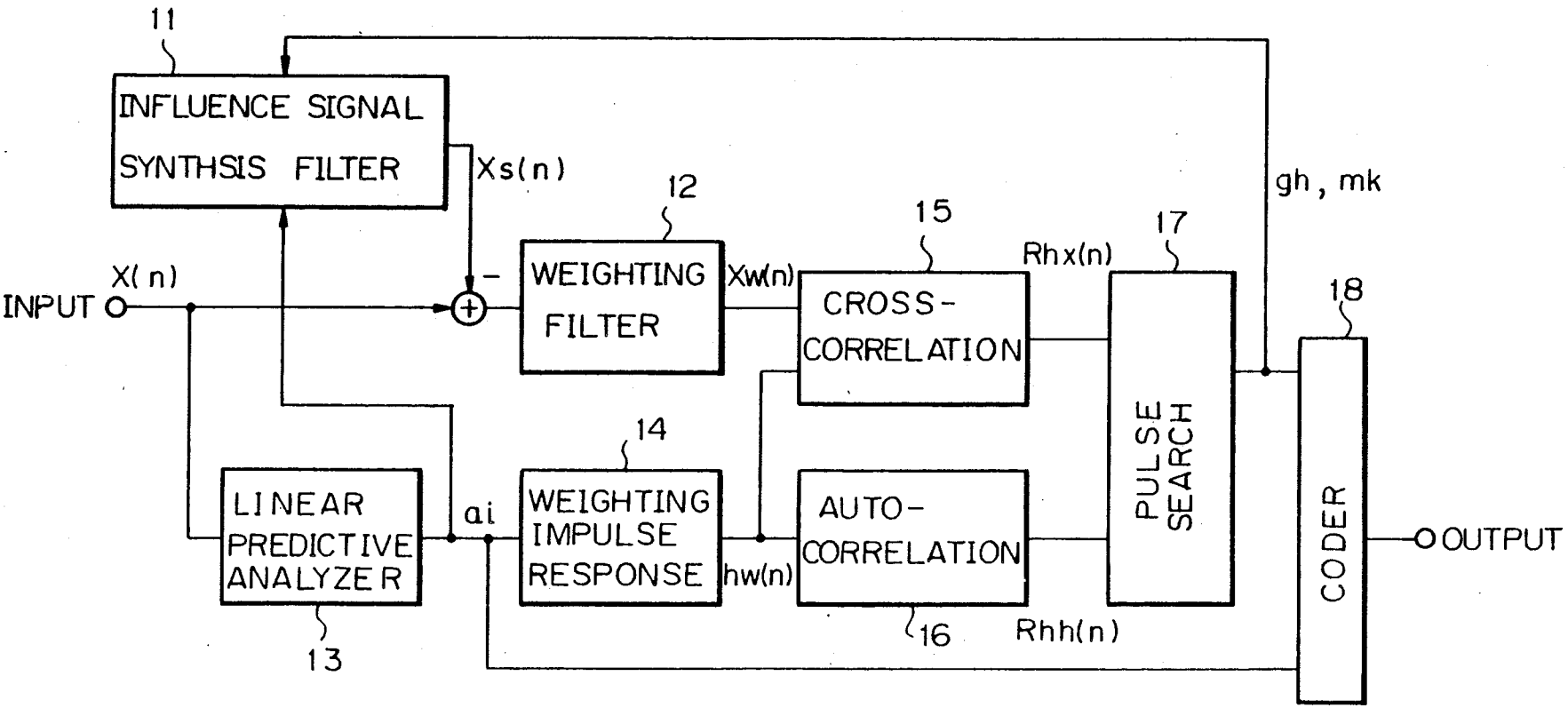
FIG. 1 is a block diagram showing a multi-pulse excitation speech coding system embodying the present invention.

Referring to FIG. 1 of the drawings, a multi-pulse excited speech coding system in accordance with the present invention is shown in a block diagram. In the figure, input speech signals are divided into frames each being made up N samples and are processed on a frame basis. Assuming that the input signal in a certain frame is X (n) (n=1, 2, . . . , N), a coder determines a coefficient of a synthesis filter for synthesizing speech of that frame, and an excitation pulse sequence for exciting the filter. A decoder, on the other hand, synthesizes speech to be reproduced, in response to the filter coefficient and the excitation pulse sequence which are transmitted thereto from the coder. Specifically, in the coder, a linear predictive analyzer 13 applies a linear predictive analysis to the input speech signal X (n) so as to determine filter coefficients $a_i$ (i=1, 2, . . . , P). A weighted impulse response section 14 produces a weighted version $h_w$(n) of the impulse response h (n) of the synthesis filter. $H_w$(z) which is the Z-transform notation of $h_w$(n) may be expressed on the basis of the Eqs. (2) and (5), as follows:

$$\begin{aligned} H_w(z) &= H(z)W(z) \\ &= 1/\left(1 - \sum_{i=1}^{P} a_i r^i Z^{-i}\right) \end{aligned} \quad \text{Eq. (12)}$$

An autocorrelation section 16 determines an autocorrelation Rhh (n) of the weighted impulse response $h_w$(n) according to the Eq. (10). An influence signal synthesis filter 11 is provided for removing the influence of the preceding frame. Specifically, while holding the last value of the preceding frame data as the initial value, the influence signal synthesis filter 11 synthesizes one frame of influence signal $X_s$(n) by using the filter coefficients $a_i$ (i=1, 2, . . . , P) for the current frame as produced by the linear predictive analyzer 13 and making the input signal zero. The influence signal $X_s(n)$ may be expressed as:

$$X_s(n) = \sum_{i=1}^{P} a_i \cdot X_s(n-1) \qquad \text{Eq. (13)}$$

where $X_s(1-P)$, $X_s(2-P)$, . . . , X (0) are the internal data of the synthetic filter associated with the preceding frame and equal to, respectively, the outputs Y (N−P+1), Y (N−P+2), . . . , Y (N) of the synthetic filter with the preceding frame.

A weighting filter 12 uses a signal produced by substracting the influence signal $X_s(n)$ from the input signal X (n) for a weight. The weighted signal $X_w(n)$ is given by:

$$X_w(n) = \sum_{i=1}^{P} a_i r^i X_w(n-i) - \sum_{i=0}^{P} a_i (X(n-i) - X_s(n-i)) \qquad \text{Eq. (14)}$$

where $a_0$ is −1.

A crosscorrelation section 15 determines crosscorrelations Rhx (n) based on the weighted signal $X_w(n)$ and the weighted impulse response $h_w(n)$ according to the Eq. (9). The crosscorrelations Rhx (n) and the autocorrelation Rhh (n) are applied to a pulse search section 17. In response the pulse search section 17 produces predetermined K pulse locations $m_k$ and K pulse amplitudes $g_k$. A coder 18 transmits the linear predictive coefficients $a_i$, pulse locations $m_k$ and pulse amplitudes $g_k$ by multiplexing them. After the pulse locations and positions have been determined, the current frame is synthesized so that the influence signal systhesis section 11 may synthesize a influence signal for the next frame.

The synthetic output Y (n) is produced by exciting a synthetic filter having a transfer function H (z) as represented by the Eq. (2), by the pulse sequence V (n) which is given by the Eq. (1). As regards the internal data of the synthetic filter, the last value of the preceding frame is held as the initial value. The synthetic output Y (n) is expressed as:

$$Y(m) = V(m) + \sum_{i=1}^{P} a_i Y(n-i) \quad n = 1, 2, \ldots, N \qquad \text{Eq. (15)}$$

Here, Y (1−P), Y (1−P), . . . , Y (0) are the internal data of the synthetic filter associated with the preceding frame and equal to, respectively, the filter outputs Y (N−P+1), Y (N−P+1), . . . , Y (N) associated with the preceding frame.

Figure 2:
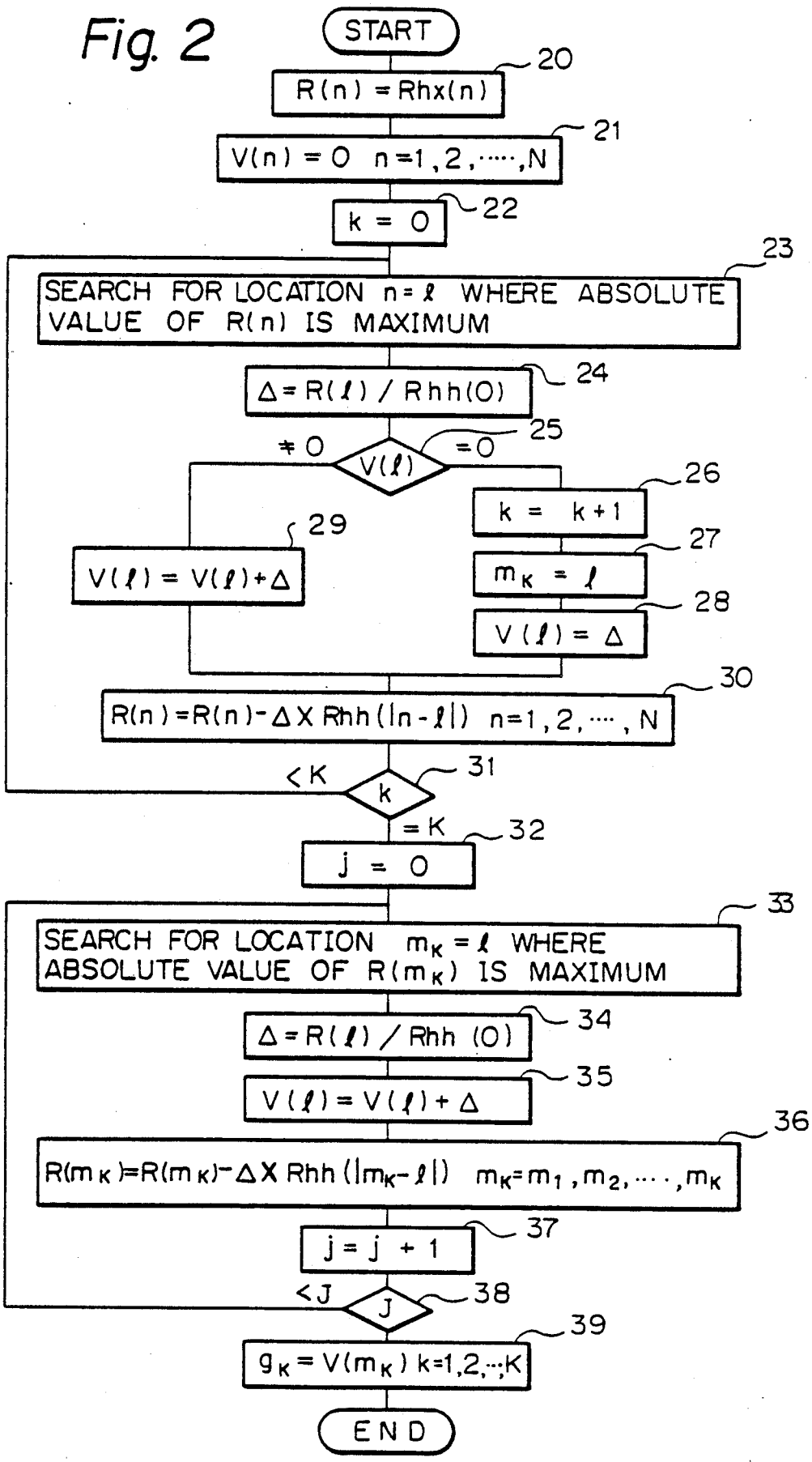
FIG. 2 is a flowchart demonstrating the operation of the present invention.

Referring to FIG. 2, a flowchart demonstrating pulse search and pulse amplitude modification in accordance with the present invention is shown.

First, in a step 20, a crosscorrelation Rhx (n) is provided as the initial value of the criterion function R (n).

In the next step 21, zero is set as the initial value of the excitation pulse sequence V (n).

In a step 22, zero is set as the initial value of the index k which is representative of the position of a pulse with respect to the order.

In a step 23, a location n=l where the absolute value of the criterion function R (n) is maximum is searched for within the range of $1 \leqq n \leqq N$.

Then, in a step 24, the amplitude Δ of a pulse to be positioned at the location l is determined such that the criterion function V (l) at the location l becomes zero, as follows:

$$\Delta = R(l)/Rhh(0) \qquad \text{Eq. (16)}$$

In a step 25, whether or not a pulse has already been positioned at the location l is decided based on the value of V (l). If no pulse is present, meaning that a new pulse has been determined, k is incremented by one in a step 26, the k-th pulse location $m_k$ is selected as l in a step 27, and a pulse whose amplitude is Δ is set at the pulse location l. Hence, V (l) becomes equal to Δ.

If a pulse is present at the location l as decided by the step 25, i.e., when V (l) is not zero, Δ is added to the amplitude V (l) of the pulse set at the location l to prepare new V (l).

The effect achieved by setting a pulse of amplitude Δ at the location l is substracted from the criterion function R (n) as follows:

$$R(n) = R(n) - \Delta \times Rhh(|n-l|) \quad m = 1, 2, \ldots, N \qquad \text{Eq. (17)}$$

Further, in a step 31, whether or not the predetermined K pulses have been determined is checked. If the number of actually determined pulses is short of K, the sequence of steps 23 to 31 described is repeated.

As regards the pulse search loop constituted by the steps 23 to 31, it may occur that it is executed more than K times, which is equal to the desired number of pulses, since the loop includes the step 29 in which a pulse is determined at a location where another pulse has already been set. After K pulses have been determined by the above procedure, the program advances to pulse amplitude modification.

Specifically, in a step 32, a counter j indicative of how many times pulse amplitude modification has been performed is loaded with zero as the initial value.

In a step 33, among the locations $m_l$ to $m_k$ where pulses have been set, the location $m_k = l$ where the absolute value of criterion function R (l) is maximum is searched for.

In a step 34, a value Δ for modifying the amplitude of the pulse at the location l such that the criterion function R (l) at the location l becomes zero is obtained by using the Eq. (16).

In a step 35, Δ is added to the amplitude V (l) of the pulse at the location l to produce new V (l) and, then, pulse amplitude modification is executed.

In a step 36, the effect produced by correcting the pulse amplitude at the location l by Δ from the criterion function R ($m_k$) is determined, as shown below:

$$R(m_k) = R(m_k) - \Delta \times Rhh(m_k - l) \quad m_k = m_1, m_2, \ldots, mk \qquad \text{Eq. (18)}$$

Then, in a step 37, j is incremented by one.

Further, in a step 38, whether the frequency of pulse amplitude modification performed has reached the predetermined one J. If the actual frequency is short of J, the steps 33 to 38 are repeated.

After pulse amplitude modification has been performed J consecutive times, V ($m_k$) at the location $m_k$ is selected to be the pulse amplitude $g_k$ at the location $m_k$, step 39.

In the pulse amplitude correcting steps 32 to 38 of the present invention, the search for the location where the absolute value of the criterion function is maximum (step 33) and the update of the criterion function (step 36) can each be accomplished by using only K locations, i.e., from the location $m_l$ where a pulse has been set to the location $m_k$. In the pulse search, i.e., steps 20 to 31, the search for the location where the absolute value of the criterion function is maximum and the update of the criterion function have to be performed at N locations each, i.e., from the location $n=1$ to the location N. Because the number of pulses K and the loop frequency J are of substantially the same order and because the number of pulses K is far smaller than the number of samples N in one frame, the calculation amount necessary for pulse amplitude modification is negligibly small, compared to that necessary for pulse search. In addition, the quality of reproduced sound is enhanced since the value of the criterion function is substantially zero.

In summary, it will be seen that in accordance with the present invention sound quality comparable with that particular to the method 2-1 or 2—2 (prior art 3) is achievable with a calculation amount which is as small as that particular to the method 1 (prior art 3).

Various modifications will become possible for those skilled in the art after receiving the teachings of the present disclosure without departing from the scope thereof.

What is claimed is:

1. A speech coding system comprising:

means for applying a linear predictive analysis to an input signal;

means for producing an impulse response of a linear predictive filter;

means for producing an autocorrelation function of said impulse response;

means for producing a crosscorrelation function between said input signal and said impulse response to use said crosscorrelation function as a criterion function;

pulse search means which sets a first pulse at a location where the criterion function is maximum, and produces a first normalized autocorrelation function of an impulse response by multiplying said autocorrelation of the impulse response by an amplitude of the pulse, and which renews said criterion function by subtracting said first normalized autocorrelation function of the impulse response from said criterion function centering around a location where the pulse is set, and which iteratively determines a predetermined number of pulses in the same manner based on said criterion function, and which modifies the amplitude of the pulse set at a location, among the locations where the pulses are set, said location being an absolute value of said criterion function is maximum, and which produces a second normalized autocorrelation function of the impulse response, in accordance with only the locations where the pulses are set, by multiplying said autocorrelation of the impulse response by the modified amount of the pulse, and which renews said criterion function by subtracting said second normalized autocorrelation function of the impulse response from said criterion function, at only the locations where the pulses are set, centering around the location where the pulse amplitude is modified, and repeats pulse amplitude modification a predetermined number of times based on said criterion function; and output means for outputting the coefficients of the linear predictive filter and the locations and amplitudes of the predetermined number of pulses.

* * * * *